US006149031A

United States Patent [19]

Bauman et al.

[11] Patent Number: 6,149,031

[45] Date of Patent: Nov. 21, 2000

[54] BEVERAGE DISPENSING MACHINE AND METHOD OF OPERATION THEREOF

[75] Inventors: Edward Frederick Bauman, Waterloo; Barry B. Bauman, Kitchener, both of Canada

[73] Assignee: Nature-Pac Inc., Waterloo, Canada; a part interest

[21] Appl. No.: 09/127,718

[22] Filed: Aug. 3, 1998

Related U.S. Application Data

[60] Provisional application No. 60/056,401, Aug. 26, 1997.

[51] Int. Cl.[7] ..... B65G 59/00; G07F 11/12

[52] U.S. Cl. ..... 221/109; 221/107; 221/225; 221/237; 221/277; 221/130

[58] Field of Search ..... 221/66, 93, 107, 221/108, 109, 110, 111, 195, 225, 237, 277, 281, 130

[56] References Cited

U.S. PATENT DOCUMENTS

| | | | |
|---|---|---|---|
| 2,453,280 | 11/1948 | Stewart | 221/107 |
| 2,459,715 | 1/1949 | Newman | 221/107 |
| 2,570,516 | 10/1951 | Bowman | 221/109 |
| 2,680,051 | 6/1954 | Jones | 221/107 |

FOREIGN PATENT DOCUMENTS

| | | | |
|---|---|---|---|
| 686981 | 3/1965 | Italy | 221/108 |

*Primary Examiner*—H. Grant Skaggs
*Attorney, Agent, or Firm*—Daryl W. Schnurr

[57] ABSTRACT

A dispensing machine is used to disperse plastic water bottles and the like, preferably of a size ranging from approximately one liter to approximately two liters or even larger. The machine can be used to dispense other products in containers as long as the containers are shaped to roll along a shelf. The machine has a vertical channel containing paddles where each paddle supports only some of the containers in the channel when the channel is filled with containers. The paddles move simultaneously to gently lower the containers one space at a time when the machine is activated.

23 Claims, 3 Drawing Sheets

BEVERAGE DISPENSING MACHINE AND METHOD OF OPERATION THEREOF

This application claims benefit of Provisional application 60/056,401, filed Aug. 26, 1997.

BACKGROUND OF THE INVENTION

Field of the Invention

This invention relates to a vending machine and method of operation of a vending machine for dispensing plastic bottles containing water or other non-carbonated beverages.

Description of the Prior Art

Vending machines for carbonated soft drinks in cans and glass bottles are known. Vending machines for glass bottles have been replaced in the marketplace by vending machines that dispense cans. The vending machines for cans often have a series of vertical columns with a rotatable flap located at the bottom of each column to close off the column. Each flap is connected to a tiny electric motor that causes the flap to open to release one can in response to an appropriate signal from the outside of the machine. The cans in each column are stacked on top of one another from the bottom portion of the machine to the top portion of the machine. Plastic bottles containing water of a size up to approximately 500 milliliters can be satisfactorily dispensed by known vending machines having a design similar to that described for cans. Large plastic bottles, of approximately one liter and above, that contain water are much more fragile than cans or glass bottles. Also, plastic containers of non-carbonated beverages present a much softer, flexible outer surface than a plastic bottle containing carbonated beverages due to the outward pressure caused by the carbon dioxide within the containers. Large plastic water bottles have relatively soft walls and, when the containers are subjected to too much pressure, the containers can tear or burst or develop a leak. This pressure can be caused by stacking too many plastic water bottles on top of one another or by allowing the water bottles to fall through too great a distance. There has been some demand for vending machines that will dispense large plastic water bottles as spring water, purified water or distilled water has become more popular as consumers become increasingly concerned that municipally supplied water contains unwanted chemicals or pollutants or has an unwanted taste. This is particularly the case in apartment buildings where water quality is often unacceptable for drinking purposes.

SUMMARY OF THE INVENTION

It is object of the present invention to provide a vending machine and a method of operation thereof whereby large plastic water bottles can be dispensed efficiently and consistently without breakage or leakage of any kind and the number of bottles that can be dispensed is limited only by the size of the vending machine.

A dispensing machine for dispensing generally flexible containers of liquid has a housing with an outlet for the containers, the housing containing a plurality of shelves that are sloped toward a vertical channel. The channel extends from below a lowermost shelf past an uppermost shelf and provides an exit passage for containers from the shelves to the outlet. The channel contains a plurality of paddles spaced vertically apart from one another. Each paddle is capable of supporting a limited number of containers within the channel. Each paddle is arranged to move simultaneously to lower one container, for each paddle, at a time from a space in the channel immediately above each paddle to a space in the channel immediately below each paddle. There are activation means, accessible outside the housing, to cause the paddles to move simultaneously to move all containers within the channel downward one space at a time and to move a lowermost container to the outlet. The housing is openable to allow access to an interior for replenishing the housing with containers.

A method of dispensing generally cylindrical, flexible containers of liquid, said containers being of a size ranging from approximately one liter to approximately two liters, using a dispensing machine having a vertical channel with a plurality of shelves sloped towards said channel, said method comprising using two or more movable paddles in said vertical channel so that when said channel is filled with containers, each paddle supports part of the containers within the channel, the paddles together supporting all of the containers within the channel, said paddles being connected to drive means so that said paddles can be simultaneously moved to gently lower each container in the channel to the next lower position by a distance of one container for each activation of the drive means, one container exiting the vertical channel and exiting the housing through an appropriate opening during each activation of the paddles.

A method of dispensing generally cylindrical, flexible containers of liquid from a dispensing machine having a vertical channel with a plurality of shelves sloped toward said channel, said dispensing machine having an outlet for said containers, said method comprising locating a plurality of supports within said channel, said supports each supporting the containers in said channel above a particular support up to a next higher support, moving each support simultaneously as money is inserted into said machine to release one container from each support, a lowermost container being released to said outlet. A method of dispensing generally cylindrical, flexible containers of liquid from a dispensing machine having a housing with an outlet for said containers, said housing containing a plurality of shelves that are sloped toward a vertical channel, said channel extending from a lowermost shelf past an uppermost shelf, said channel containing a plurality of paddles spaced vertically apart from one another with each paddle having at least three substantially equal sections, said paddles being interconnected to be rotated simultaneously, with activation means to activate said paddles from outside said housing, thereby moving all containers within the channel downward one space at a time and moving a lowermost container to said outlet, said housing being openable to allow access to an interior thereof for replenishing said housing with containers, said method comprising opening said housing to expose said interior, placing containers within said vertical channels so that a longitudinal axis of said containers is parallel to a longitudinal axis of said paddles, placing containers transversely of said shelves so that said containers can roll towards said channel by gravity, activating said means accessible from outside said housing to rotate said paddles to said drive means so that said paddles rotate by a distance of one section each time said drive means is activated to lower one container from a space immediately above each paddle to a space immediately below each paddle, each paddle supporting only part of said containers in said vertical channel when said vertical channel is filled with containers, successively activating said activation means to remove one container at a time, ultimately emptying said housing of containers commencing at the uppermost shelf containing containers and ending at the lowermost shelf containing containers.

DESCRIPTION OF A PREFERRED EMBODIMENT

Figure 1:
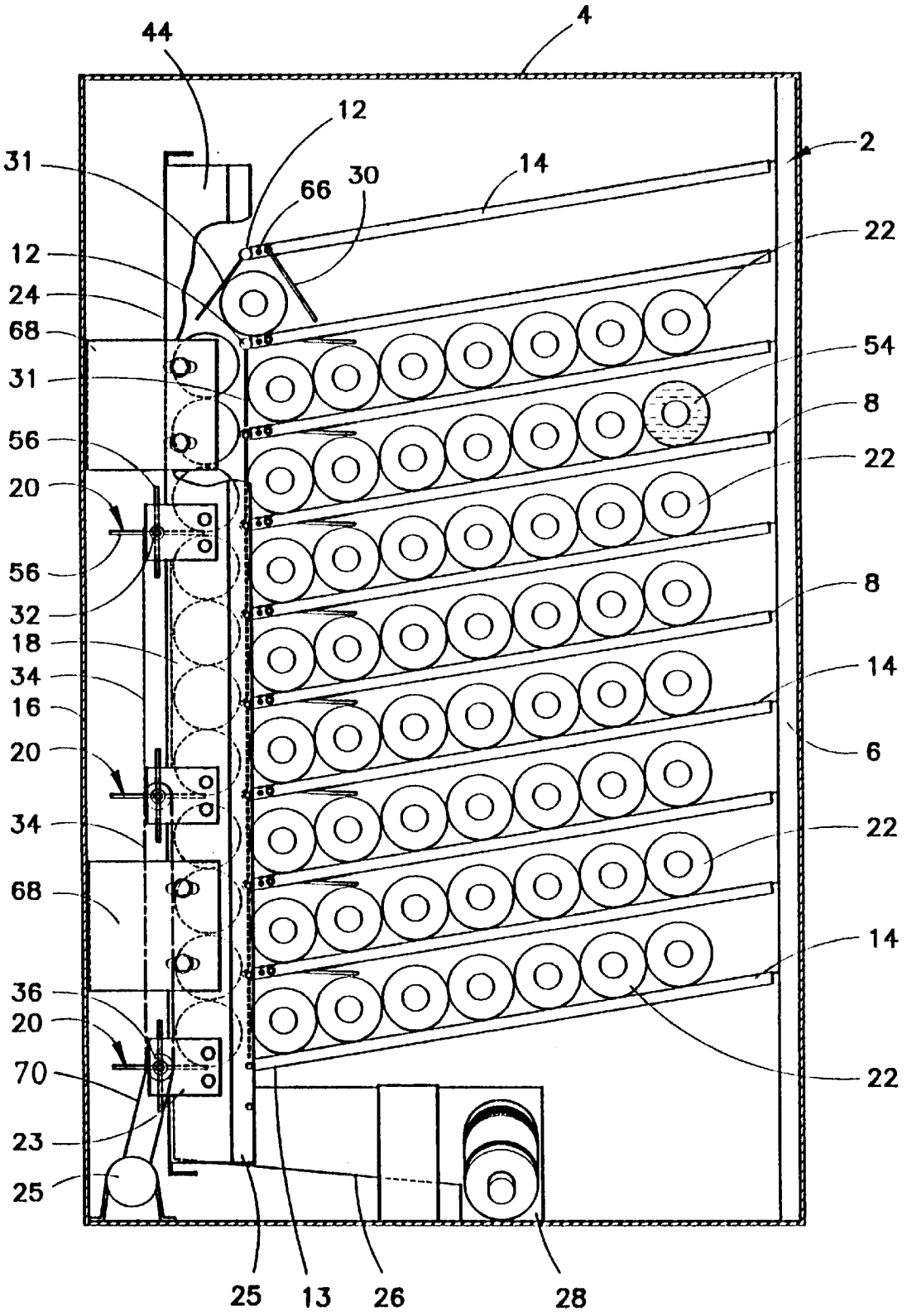
FIG. 1 is a front view of a vending machine for use in dispensing plastic bottles that are filled with water.
Figure 2:
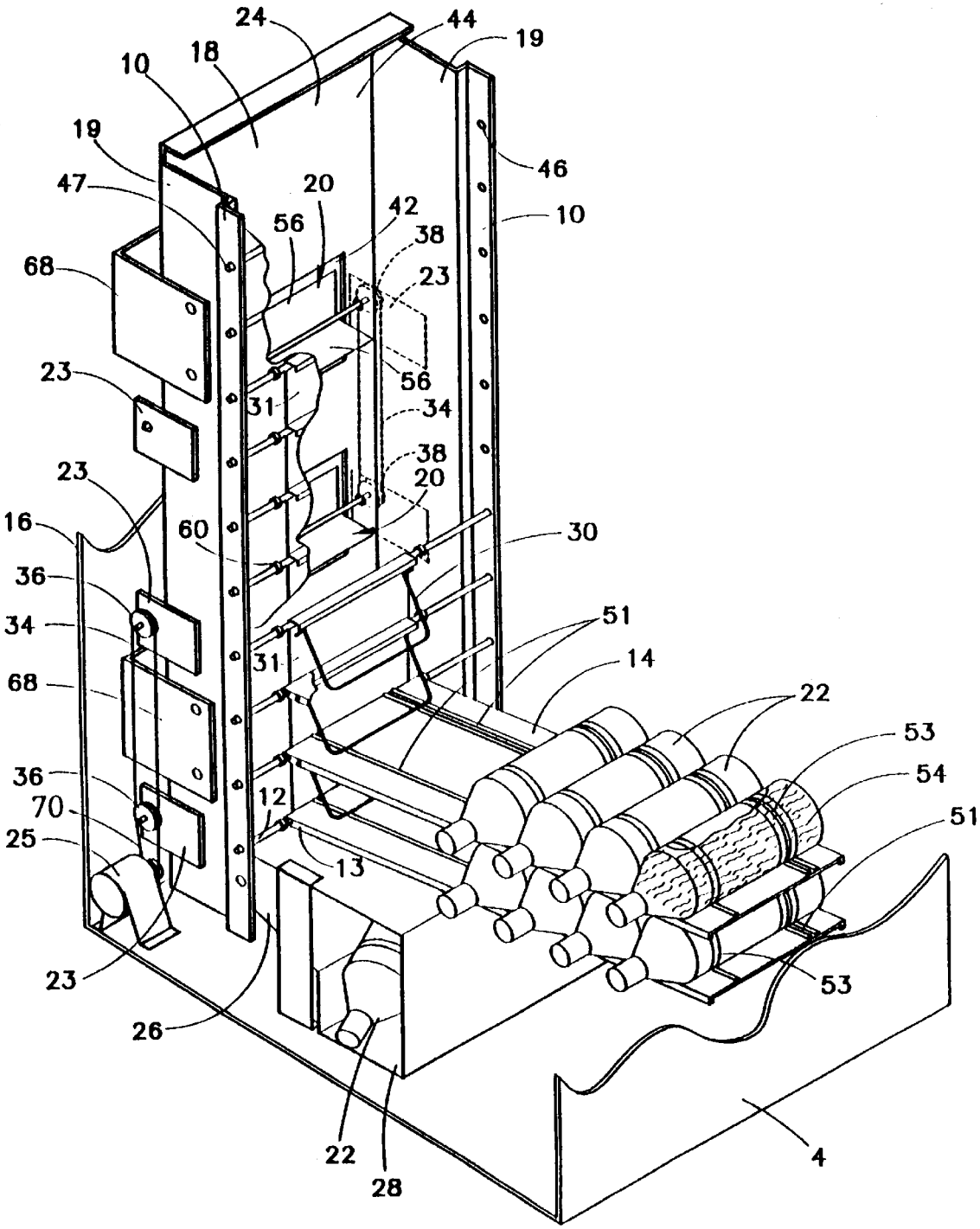
FIG. 2 is a partial perspective view of the vending machine of FIG. 1.

In the drawings, in FIGS. 1 and 2, a vending machine 2 has a housing 4 with one vertical support 6 having clips 8. The vertical support 6 is preferably centrally mounted on an outside wall of the housing 4. Two additional vertical supports 10 are spaced apart from one another (only one of which is shown). Support rods 12 extend horizontally between the supports 10. The support 10 shown in FIG. 1 is partially cut away to expose the rods 12 that support a lower end 13 of each shelf 14. The support 6 supports one end of each shelf 14 and the supports 10 supports an opposite end of each shelf. Components that would be hidden from view by the support 10 are shown with dotted lines. The lower end 13 of each shelf 14 rests on a top of the rods 12. The rods 12 are lower than corresponding clips 8 so that shelves 14 extending between each of the rods 12 and corresponding clips 8 are located at an angle extending downward from the clips 8 to the rods 12. The support 6 support one end of the shelves 14 and the supports 10 support an opposite end. In FIG. 1, ten shelves 14 are shown. If the housing was larger, more shelves and bottles could be located in the machine. Also, the shelves could be located closer together but are spaced as shown in FIG. 1 for ease of illustration.

Along a side 16 of the housing 4 there is located a vertical channel 18. The vertical channel 18 contains three paddles 20 that are spaced vertically apart from one another. The lowermost paddle is located slightly below the lowermost shelf. The paddles 20 are mounted so that they are rotatable about their longitudinal axis. Large plastic bottles 22, preferably filled with water or other non-carbonated beverages are located on the shelves as shown and fill the channel 18 up to a height of eleven bottles. The uppermost shelf is empty and a second shelf from the top only has one bottle remaining on it to show how the machine operates. When the machine is completely filled, all of the shelves are filled and the vertical channel will have twelve bottles therein with a thirteenth bottle from the uppermost shelf partially in the channel 18. A guide wall 24 is located in the channel 18 to maintain the bottles within the channel vertically above one another. The guide wall 24 is connected to each of the vertical supports 10 by sides 19. The guide wall 24 has suitable openings 42 therein to allow the paddles 20 to rotate about their longitudinal axis. The paddles 20 are rotatably supported by small brackets 23 and a drive means 25, which will be referred to in more detail below. The paddles are interconnected to drive means 25 so that all of the paddles 20 rotate simultaneously. Beneath the channel 18 is a ramp 26 that is sloped in an opposite direction to the shelves 14 to an outlet 28.

There is a wire retainer 30 preferably mounted beneath each shelf near the vertical channel 18. When there are two or more bottles 22 beneath the retainer 30, the retainer remains in a retracted (upper) position and bottles can roll to the channel 18 from the shelf beneath the retainer. When the shelf is empty or a space develops between bottles or there is only one bottle left on the shelf as shown for the second shelf from the top, the retainer will shift downward by gravity and prevent any further bottles to the right of the lowered retainer on that particular shelf from rolling into the vertical channel 18. For example, for the second shelf from the top, the one bottle left on the shelf will be able to enter the vertical channel 18, but any bottles that were located to the right of the lowered retainer would not be able to enter the vertical channel. Sometimes one of the bottles on a shelf is flat on one side henceforth referred to as a defective bottle and will not roll along the shelf. The bottles on the shelf that are lower than the defective bottle in turn enter the vertical channel but the defective bottle and the bottles on the shelf that are higher than the defective bottle do not roll toward the vertical channel. The retainer 30 will fall down by gravity when there are no bottles beneath it to keep the retainer in the raised position. The retainer will then block the defective bottle and any bottles behind the defective bottle from entering the vertical channel. If the retainer is not used and the defective bottle becomes dislodged well after the uppermost bottles in the vertical channel have moved below the shelf where the defective bottle is located, the defective bottle will free fall for some distance into the vertical channel and the impact when the defective bottle contacts other bottles or a paddle could damage one or more of the paddles 20.

It can be seen that there is a drive means 25 for the paddles 20 which are each rotatably mounted about a separate longitudinal axis 32. The two lowermost paddles 20 have a chain 34 extending between sprockets 36. The two uppermost paddles 20 have a chain 34 extending between sprockets 38 so that the paddles move in unison as the drive means 25 is activated. In addition to the rods 12 supporting the shelves 14 also support a gate 31. The guide wall 24 has openings 42 therein to accommodate each of the paddles 20. Many of the rods 12 and gates 31 are only partially shown in FIG. 2 to expose components behind the rods 12 and gates 31.

Figure 4:
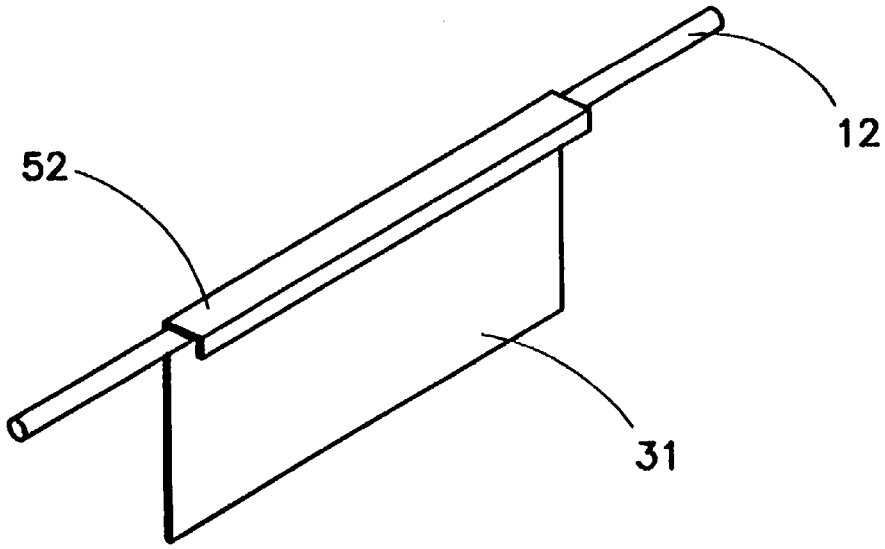
FIG. 4 is an enlarged perspective view of the gate on a support rod.

The partial perspective view of FIG. 2 shows two shelves 14 being supported at the lower end 13 by the rods 12. The vertical support 6 and the clips 8 are not shown in FIG. 2. The vertical supports 10, two sides 19 and the guide wall 24 comprise a U-shaped end piece 44 which provides support for the rods 12 (only one of which is shown in FIG. 4) as well as support for the paddles 20. The six small brackets 23 (only five of which are shown in FIG. 2) are mounted on either side of the end piece 44. The rods 12 extend between openings 46 and are held in place by rod collars 47. The paddles 20 are rotatably mounted in openings 42 of the end piece 44. Each of the rods 12 has a gate 31 rotatably hanging therefrom. Each shelf preferably has guides 51 thereon to fit within corresponding grooves 53 in each bottle 22 so that the bottles will roll straight along the shelf.

In FIGS. 1 and 2, only one plastic bottle 22 in each Figure is shown to contain water 54 as representative of all the bottles. While the dispenser could be used to dispense smaller bottles or containers, it is preferably used to dispense bottles or containers in the size range of approximately one liter to approximately two liters or even larger. While water dispensing is preferred, the bottles can contain other non-carbonated beverages as well and can also contain carbonated beverages. The containers are not required to be bottles, but are required to have a generally cylindrical shape, when not defective, so they can roll along the shelves. While the preferred use of the machine is to dispense containers of liquid, the machine can be used to dispense other products in generally cylindrical containers as well. For example, solid food products can be dispensed. The solid food products can be any suitable product, but would preferably be a relatively dense or heavy product such as a meat product. The machine can be refrigerated in any conventional manner as desired. The products being dispensed could even be frozen. When water is dispensed, the machine will usually not be refrigerated. The bottles 22 in FIG. 2 are located towards the upper end of each shelf to show how the bottles rest on the shelves. The bottles have been omitted from the vertical channel 18 and the lower part of the shelves 14 in FIG. 2 to expose the wire retainers 30 and the paddles 20 along with other components. It can be seen that the longitudinal axis 32 of each paddle 20 has wings 56 extending from it, the wings being substantially 90° apart from one another. Preferably, the paddles stop after each movement (ie. after each quarter turn where there are four wings) so that the wing 56 that is nearest the shelves 14 is at an angle to the horizontal that is parallel to a plane through an upper surface of the shelves.

Figure 3:
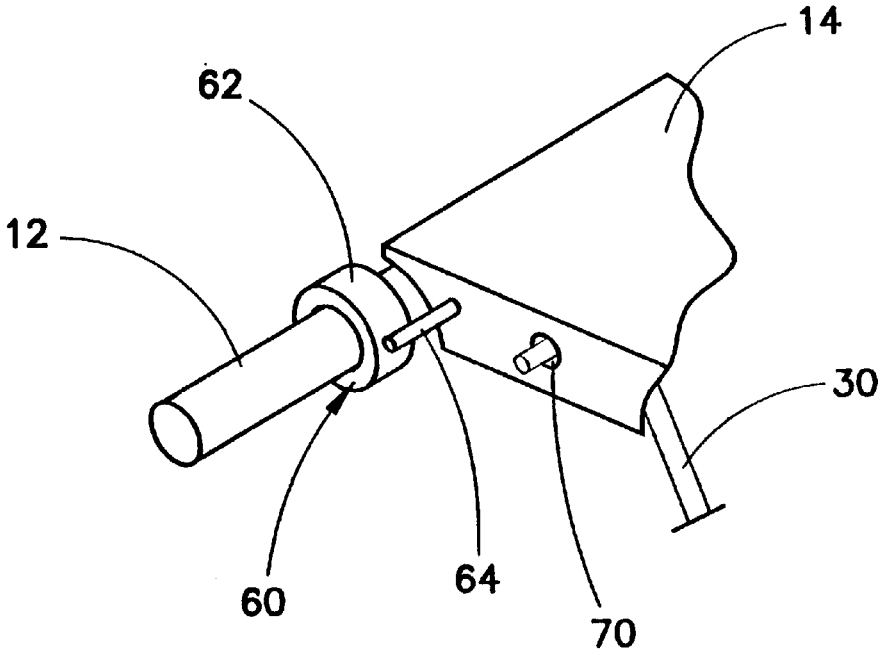
FIG. 3 is an enlarged partial perspective view of a shelf lock and retainer wire.

As best shown in FIG. 3 a shelf lock 60 is located on one side of each shelf 14 on each rod 12. There is one shelf lock 60 on each rod 12. The purpose of the shelf lock 60 is to hold the shelves 14 down on the rod 12 so the shelves will not lift up when the retainer 30 is lowered down and a bottle or bottles roll against the retainer. Preferably, the shelf locks are held in place by an Allen nut (not shown). If the shelf were to lift up the bottle(s) would roll past the retainer and into the vertical channel 18. The shelf lock 60 has a ring 62 and pin 64. The ring 62 fits over the end of the rod 12 and can slide onto the rod until the pin 64 enters an opening 66 (see FIG. 1) in each shelf 14.

Since the uppermost shelf 14 has no shelf above it, the wire retainer 30 for the uppermost shelf is connected to a suitable bracket (not shown) which is connected to the vertical supports 10. The U-shaped end piece 44 is connected to an interior of the side 16 of the housing 4 by brackets 68.

In FIG. 4, there is shown a perspective view of a gate 31 on a rod 12. The gate has a loop 52 that extends around each of the rods 12 so that the gate can swing freely on the rod. When a large water bottle is located on one side of the gate within the channel 18, the bottles on the other side of the gate located on the shelf 14 cannot roll into the channel 18 as the gate remains closed (see FIG. 1). The gates 31 operate solely by gravity and are prevented from opening when there is a bottle adjacent to the gate within the channel 18. When there is no bottle adjacent to a gate in the channel 18 and there is a bottle on one of the shelves 14 in contact with that gate, the bottle 22 will roll into the gate causing it to open and the bottle will enter the channel 18.

In operation, the machine 2 is filled (or at least partially filled) with water bottles. During filling the shelves 14 located adjacent to the middle and upper paddles are left loose so these shelves can be lifted up, the gate 31 can be moved and a bottle can be placed in the vertical channel immediately beneath the paddle. The vertical channel is filled from the shelf above the space in the vertical channel that is desired to be filled (except that the space beneath the upper and middle paddles is not accessible from the shelf above). When the bottles are in place in the two locations, the gate and shelf is placed back in position. Preferably, the shelf locks are left loose on these two shelves to allow the locks to be easily removed and the shelves to be easily lifted. There are activation means (not shown) from outside the machine (for example, by inserting money into the machine), to activate the drive means 25 which rotates each of the paddles 20 simultaneously a distance of 90° clockwise. Each of the paddles 20 that has one bottle resting directly thereon lowers that one bottle by the distance of one bottle to a space immediately beneath the paddle (except for the bottle on the lowermost paddle 20). The lowermost bottle 22 in the channel 18 falls onto the ramp 26 and rolls to the exit 28. All of the bottles in the channel 18 move downward by the distance of one bottle and the gate 31 on the uppermost shelf that contains bottles swings open to release one bottle from that shelf into the channel 18. When that one bottle is released, the channel 18 is filled with bottles up to the level of the uppermost shelf that contains bottles. The procedure is repeated to release bottle after bottle until the machine is empty or nearly empty of bottles. The machine empties from the top down. When the machine is nearly empty, it is preferably refilled with bottles. Both the channel 18 and the shelves 14 are filled from the bottom up. Preferably, the channel is filled first up to the level of the next empty shelf to prevent bottles placed on the shelves from rolling into the channel. Bottles falling some distance into the channel could damage the paddles. Preferably, the drive means 25 is an electric motor with an electrical or mechanical brake. If the motor doesn't have a brake, the paddles can rotate under the weight of the bottles when the motor is off.

When the dispensing machine of the present invention is completely filled, it can be seen that each paddle will support a maximum of four bottles in the vertical channel. As each bottle is removed from the machine, the bottles in the vertical channel move down one space at a time. The machine described works well with bottles of a size of approximately 1.5 liter and that size or approximately that size is preferred. For bottles larger than approximately 1.5 liters, one may want to design the machine to support a maximum of less than four bottles on each paddle. The machine can be designed, within the scope of the attached claims, to have more than four bottles or fewer than four bottles supported by each paddle depending on the size and weight of the bottles. Preferably, the number of bottles or containers supported by each paddle ranges from three to five when said channel is filled with bottles or containers respectively.

The activation means is conventional. For example, when a user inserts a coin into a coin slot on the outside of the machine, the coin can trip a switch that causes the power source to rotate each paddle by one quarter turn. The paddles can each have more or fewer than four wings. Preferably, the wings are located to create substantially equally sized sections. The drive means 25 is preferably an electric motor that is connected to the sprocket 36 nearest the motor by a chain or belt 70 or by direct coupling to the rod (not shown). The bottles 22 or other containers can be made of flexible plastic or other suitable flexible material or rigid material, for example, metal.

The machine of the present invention is particularly suited to dispense containers of products where the container is flexible and the product is relatively heavy so that the container will likely buckle or will likely be damaged when too many containers are stacked on top of one another within previous dispensing machines. The machine of the present invention solves this problem by gently lowering the containers one by one through the vertical channel. For example, the machine can be used to dispense other containers as well. For example, the machine could be used to dispense water bottles of approximately 500 ml or cans of carbonated or non-carbonated beverages by scaling the machine downward.

We claim:

1. A dispensing machine for dispensing generally cylindrical flexible containers of liquid and the like, said machine comprising:

(a) a housing with an outlet for said containers, said housing containing a plurality of shelves that are sloped toward a vertical channel;

(b) said channel extending from below a lowermost shelf past an upper most shelf, said channel providing an exit passage for containers from said shelves to said outlet;

(c) said channel containing a plurality of paddles spaced vertically apart from one another, each paddle being capable of supporting a limited number of containers within said channel;

(d) said paddles being arranged to move simultaneously to lower one container, for each paddle, at a time from a space in said channel immediately above each paddle to a space in said channel immediately below each paddle;

(e) with activation means, accessible from outside said housing, to cause said paddles to move simultaneously, thereby moving all containers within the channel downward one space at a time and moving a lowermost container to said outlet; and (f) said housing being openable to allow access to an interior of said housing for replenishing said housing with containers.

2. A dispensing machine as claimed in claim 1 wherein each of said paddles has at least two substantially equal sections and said paddles rotate by a distance of one section about a longitudinal axis when said activation means is activated.

3. A dispensing machine as claimed in claim 2 wherein each of said paddles has at least three substantially equal sections.

4. A dispensing machine as claimed in claim 3 wherein there are means to control entry of said bottles into said channel.

5. A dispensing machine as claimed in claim 4 wherein the means to control entry of said bottles into said channel is a gate located at a lower end of each shelf, said gate having an open position and a closed position, said gate remaining in said closed position when there are one or more bottles in said channel immediately outside of said gate, said gate opening when there are no bottles immediately adjacent to an outside of said gate.

6. A dispensing machine as claimed in claim 3 wherein there are three paddles within said vertical channel, a lowermost paddle, an uppermost paddle and an intermediate paddle.

7. A dispensing machine as claimed in claim 6 wherein said paddles are spaced apart from one another so that each paddle supports four containers within said channel when said channel is filled with containers.

8. A dispensing machine as claimed in claim 7 wherein the intermediate paddle has sprockets at both ends thereof, the uppermost paddle has a sprocket at one end thereof and the lowermost paddle has a sprocket at an opposite end thereof, a first chain connecting the sprockets of said lowermost paddle and said intermediate paddle and a second chain connecting the sprockets of said intermediate paddle and said uppermost paddle, one of said paddles being connected to drive means so that said paddles can rotate simultaneously.

9. A dispensing machine as claimed in claim 3 wherein each paddle has a longitudinal axis and said containers have a longitudinal axis, said paddles being oriented within said channel to receive said containers so that the longitudinal axis of said paddles and the longitudinal axis of said containers is parallel to one another.

10. A dispensing machine as claimed in claim 3 wherein each paddle has four sections of approximately equal size.

11. A dispensing machine as claimed in claim 3 wherein the containers are bottles and each paddle supports a number of bottles ranging from three to five bottles within said channel when said channel is filled with bottles.

12. A dispensing machine as claimed in claim 3 wherein the housing has two sides and the vertical channel extends along one side of said housing.

13. A dispensing machine as claimed in claim 3 wherein the shelves are parallel to one another and spaced apart from one another by a perpendicular distance that is substantially equal to, but slightly larger than, a diameter of the containers.

14. A dispensing machine as claimed in any one of claims 2, 3 or 10 wherein there is a chain extending between sprockets on each of said paddles, one of said sprockets being connected to a power source, said power source rotating each paddle simultaneously a distance of one section each time that the power source is activated.

15. A dispensing machine as claimed in any one of claims 2, 3 or 10 wherein said shelves are spaced apart from one another and said paddles are spaced apart from one another by sufficient distance to dispense containers of a fixed size, said size ranging from approximately one liter to approximately two liters.

16. A dispensing machine as claimed in claim 3 wherein the containers are located transversely on said shelves so that said containers roll toward said channel by gravity.

17. A dispensing machine as claimed in claim 3 wherein an interior of said housing is substantially filled with containers when said channel and said shelves are filled.

18. A dispensing machine as claimed in claim 3 wherein when the machine is activated to dispense a container, the machine is adapted so that an uppermost shelf that has containers supplies a container to the vertical channel.

19. A dispensing machine as claimed in claim 3 wherein part of said activation means is a coin slot.

20. A dispensing machine as claimed in claim 3 wherein part of said activation means is a money receptacle.

21. A method of dispensing generally cylindrical, flexible containers of liquid and the like, said containers being of a size ranging from approximately one liter to approximately two liters, using a dispensing machine having a vertical channel with a plurality of shelves sloped toward said channel, said method comprising using two or more movable paddles in said vertical channel so that when said channel is filled with containers, each paddle supports part of the containers within the channel, the paddles together supporting all of the containers in the channel, said paddles being connected to drive means so that said paddles can be simultaneously moved to gently lower each container in the channel to the next lower position by a distance of one container for each activation of the drive means, one container exiting the vertical channel and exiting the housing through an appropriate opening during each activation of the paddles.

22. A method of dispensing generally cylindrical, flexible containers of liquid and the like from a dispensing machine having a housing with an outlet for said containers, said housing containing a plurality of shelves that are sloped toward a vertical channel, said channel extending from a lowermost shelf past an uppermost shelf with activation means to activate said machine to dispense a container from outside said housing, past an uppermost shelf, said method comprising locating a plurality of supports within said channel, said supports each supporting the containers in said channel above a particular support up to a support immediately above the particular support, moving each support simultaneously as money is inserted into said machine to release one container from each support, a lowermost container being released to said outlet.

23. A method of dispensing as claimed in claim 22 wherein said supports within said channel are a plurality of paddles spaced vertically apart from one another with each paddle having at least three substantially equal sections, said paddles being interconnected to rotate simultaneously, thereby moving all containers within the channel downward one space at a time and moving a lowermost container to said outlet, said housing being openable to allow access to an interior thereof for replenishing said housing with containers, said method comprising opening said housing to expose said interior, placing containers within said vertical channel so that a longitudinal axis of said containers is parallel to a longitudinal axis of said paddles, placing containers transversely of said shelves so that said containers can roll towards said channel by gravity, activating said activation means to lower one container from a space immediately above each paddle to a space immediately below paddle, each paddle supporting only part of said containers within said channel when said channel is filled with containers, successively activating said activation means to remove one container at a time, ultimately emptying said housing of containers commencing at the uppermost shelf containing containers and ending at the lowermost shelf containing containers.

* * * * *